US005383829A

United States Patent [19]

Miller

[11] Patent Number: 5,383,829

[45] Date of Patent: * Jan. 24, 1995

[54] STATIONARY EXERCISE DEVICE

[76] Inventor: Larry Miller, 1628 Treeside Dr., Rochester, Mich. 48307

[ * ] Notice: The portion of the term of this patent subsequent to Sep. 7, 2010 has been disclaimed.

[21] Appl. No.: 106,378

[22] Filed: Aug. 13, 1993

Related U.S. Application Data

[63] Continuation of Ser. No. 953,897, Sep. 30, 1992, Pat. No. 5,242,343.

[51] Int. Cl.[6] ..... A63B 69/16; A63B 22/04

[52] U.S. Cl. ..... 482/57; 482/51

[58] Field of Search ..... 482/51, 52, 53, 57, 482/58, 70, 110, 148

[56] References Cited

U.S. PATENT DOCUMENTS

| | | | |
|---|---|---|---|
| 219,439 | 9/1879 | Blend . | |
| 2,603,486 | 7/1952 | Hughes | 272/79 |
| 3,316,899 | 5/1967 | Brown | 128/25 |
| 3,759,511 | 9/1973 | Zinkin et al. | 272/58 |
| 4,509,742 | 4/1985 | Cones | 272/73 |
| 4,645,200 | 2/1987 | Hix | 272/73 |
| 4,720,093 | 1/1988 | Del Mar | 272/70 |
| 4,869,494 | 9/1989 | Lambert, Sr. | 272/73 |
| 4,949,954 | 8/1990 | Hix | 272/73 |

FOREIGN PATENT DOCUMENTS 2919494 11/1980 Germany .

*Primary Examiner*—Stephen R. Crow

*Attorney, Agent, or Firm*—Howard & Howard

[57] ABSTRACT

An exercise device includes a pair of foot engaging links. The first end of each link is supported for rotational motion about a pivot axis and a second end of each foot link is guided in a reciprocal path of travel. The combination of these foot link motions permits the users foot to travel in an inclined, oval path of travel. This natural foot action exercises a large number of muscles through a wide range of motion.

7 Claims, 4 Drawing Sheets

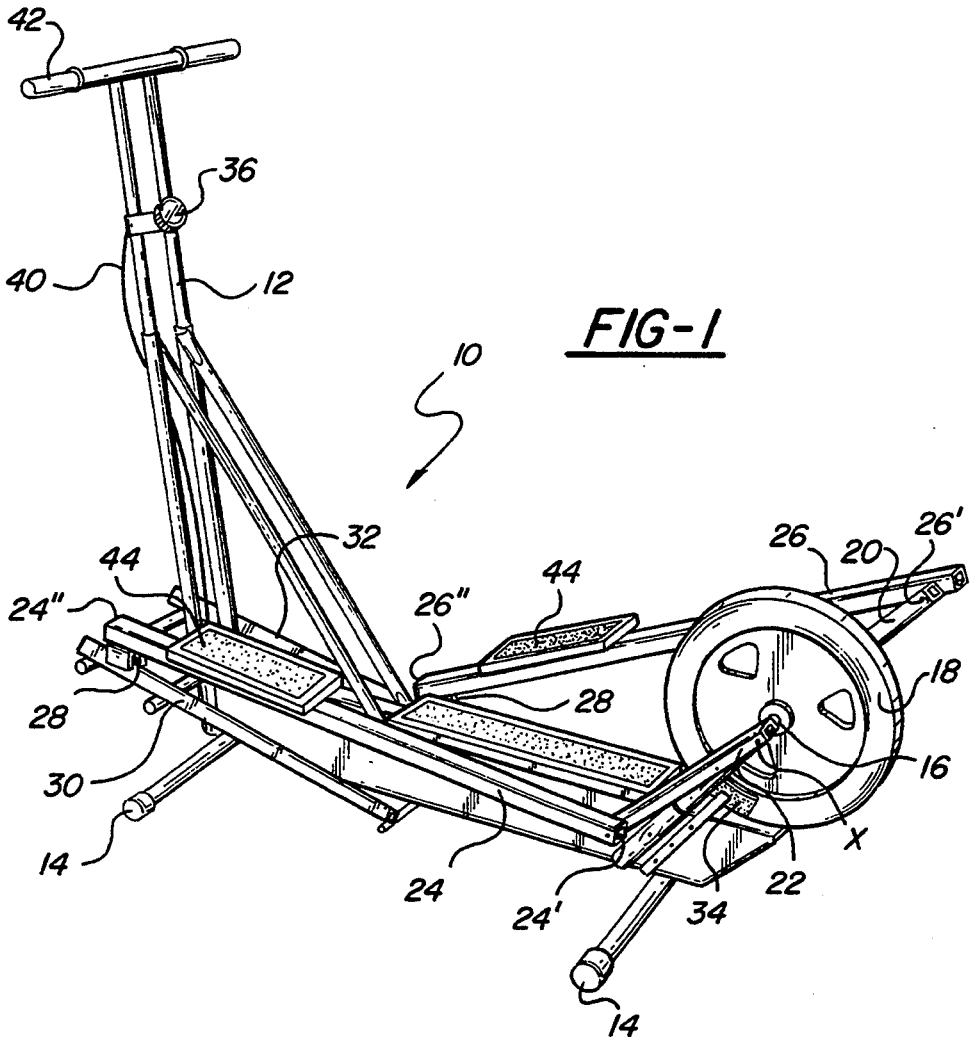
FIG-1
FIG-2A
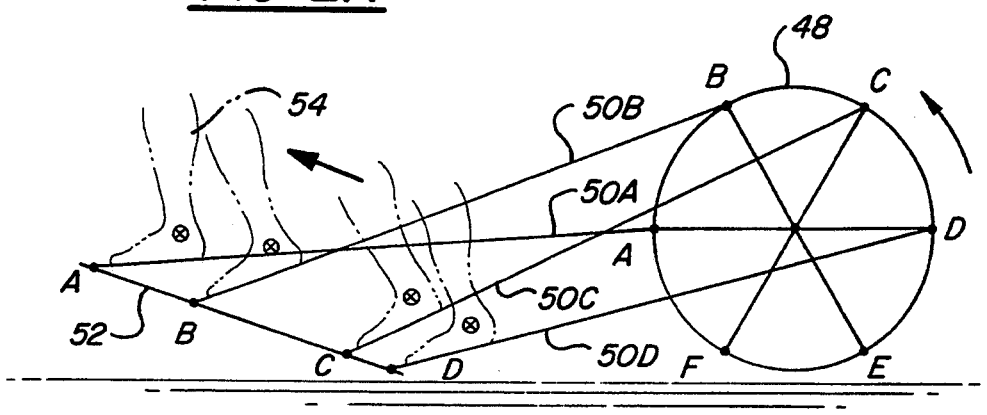

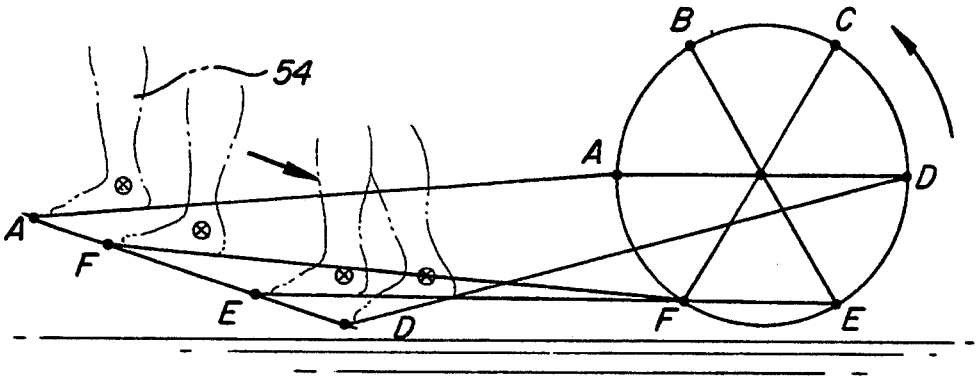
FIG-2B
FIG-2C
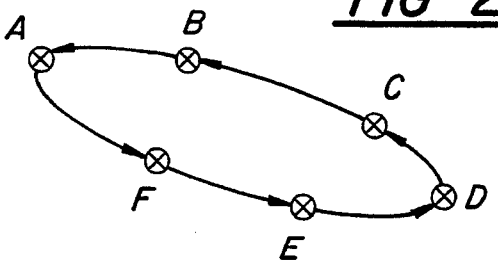
FIG-3
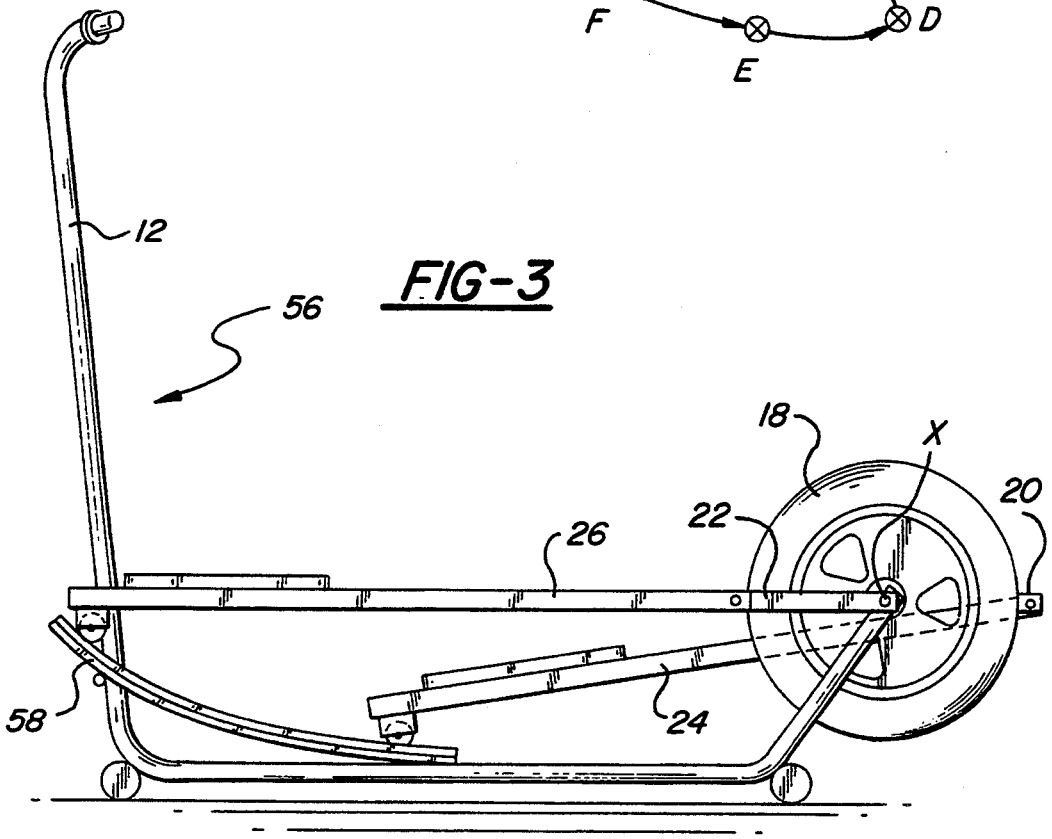

STATIONARY EXERCISE DEVICE

This application is a continuation of application Ser. No. 07/953,897, filed Sep. 30, 1992, now U.S. Pat. No. 5,242,343.

FIELD OF THE INVENTION

This invention relates generally to exercise equipment. More specifically, the invention relates to a stationary exercise device for simulating running and stepping motions.

BACKGROUND OF THE INVENTION

Because of a growing appreciation for the benefits of regular exercise; and because constraints of time and space prevent many persons from indulging in activities such as running, swimming and walking, the market for exercise equipment is rapidly increasing. It is generally desirable to exercise a number of different muscles over a fairly large range of motion so as to provide for even physical development and a maximum level of aerobic exercise. It is further desirable that exercise equipment provide a smooth, relatively natural motion so as to avoid jarring or irregular strains which can damage muscles and joints. It is also desirable that exercise equipment be relatively easy to use and of simple, low cost construction.

While a number of different exercise systems are known in the prior art, such systems suffer from a number of shortcomings which limit their utility. Stationary bicycles are widely used; however, they are employed in a sitting position and consequently, the number of muscles exercised is small. Furthermore, the range of motion provided by a stationary bicycle is fairly limited. Stationary devices for simulating cross country skiing are also in widespread use. While these systems exercise more muscles than do stationary bicycles, the relatively flat, shuffling foot motion provided thereby does not adequately exercise all of the leg muscles through a wide range of motion. Stair climbing equipment also exercises more muscles than do stationary bicycles; however, the rather limited up and down motion provided thereby does not exercise leg muscles through a large range of motion. Treadmills and the like permit walking or jogging in a relatively limited area; however, they can be quite jarring to knee and ankle joints, and many users find it difficult to maintain balance on a treadmill.

U.S. Pat. No. 4,720,093 shows a climbing type exerciser. U.S. Pat. No. 4,509,742 shows a stationary bicycle which provides for arm motion. U.S. Pat. No. 2,603,486 shows a bicycle type exerciser providing for combining arm and leg motions. U.S. Pat. No. 5,039,088 shows another bicycle type exerciser providing for hand motion.

Despite the large number of exercise devices known in the prior art there is still a need for an exercise device which is simple to manufacture and use and which provides for a smooth, natural action and which exercises a relatively large number of muscles through a large range of motion. The exercise device of the present invention, as will be described herein below, provides for a smooth stepping-running motion which exercises a user's legs more fully than cycling or skiing devices. The device of the present invention may also be employed to provide arm and shoulder motions. The smooth action of the device prevents trauma to joints and muscles.

These and other advantages of the present invention will be readily apparent from the drawings, discussion and description which follow.

BRIEF DESCRIPTION OF THE INVENTION

There is disclosed herein an exercise device which comprises a frame having a fixed pivot axis defined thereon. The device includes a first and second foot link each having a first and a second end. The device includes a coupling member associated with the first end of each foot link for pivotally coupling the first end to the pivot axis at a predetermined distance therefrom so that the first end of each foot link travels in an arcuate path of travel about the pivot axis. The device also includes a first and second guide member, each operable to engage the second end of a respective one of the foot links and to direct the second end along a preselected, reciprocating path of travel as the first end of the link travels along the arcuate path. In particular embodiments, the coupling member may comprise a bell crank or a flywheel employed either singly or in combination. The device may include braking means for increasing drag of the system to thereby increase the level of exercise required. The guide member may comprise a track which engages and directs the foot links, or it may comprise a pair of arms which are pivotally attached to the frame and to the second end of each foot link so as to permit the ends of the foot links to swing along in said reciprocal path of travel.

BRIEF DESCRIPTION OF THE DRAWINGS

FIG. 1 is a perspective view of a first embodiment of the exercise device structured in accord with the principles of the present invention;

FIG. 2*a* is a schematic depiction of the path of travel of a user's foot during the forward and upward portion of the operational cycle of the apparatus of the present invention;

FIG. 2*b* is a schematic depiction of the rearward and downward path of travel of the user's foot in the operational cycle of the present invention;

FIG. 2*c* is an illustration of the oval path of travel transversed by the foot of a person using the exercise device of the present invention;

FIG. 3 is a side elevational view of another embodiment of a the apparatus structured in accord with the principles of the present invention;

DETAILED DESCRIPTION OF THE INVENTION

Figure 4:
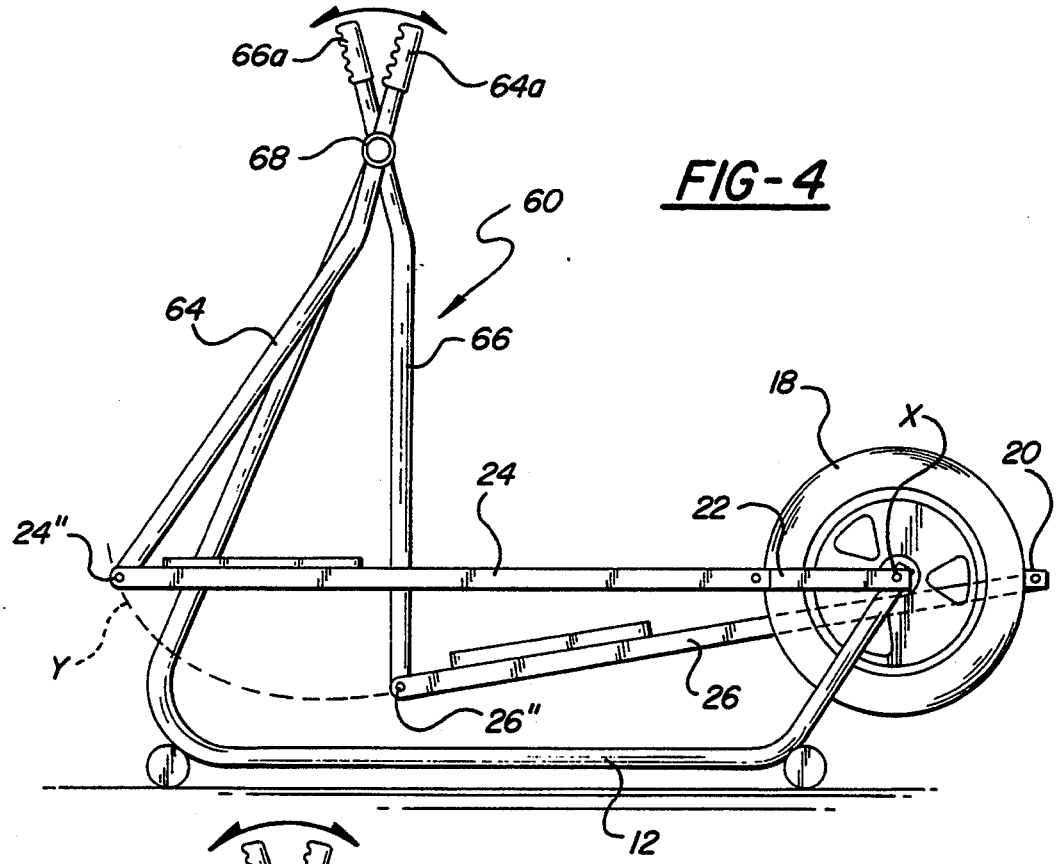
FIG. 4 is a side elevational view of yet another embodiment of the present invention.

Referring now to FIG. 1, there is shown a first embodiment of an exercise device structured in accord with the principles of the present invention. The exerciser includes a frame 12 having a pair of legs 14 disposed to support the frame 12 on a floor or other such surface. The frame 12 has a pivot axis, X, defined therein, as for example by a shaft 16 passing through, and supported by the frame 12.

In the illustrated embodiment, the shaft 16 has a flywheel 18 supported thereupon for rotation about the pivot axis X. The apparatus further includes a first and second bell crank 20, 22 pivotally mounted for rotation about the axis X. The apparatus further includes a first and a second foot links, 24, 26 respectively. The foot links 24, 26 are generally elongated members having a first end 24', 26' respectively, pivotally connected to the coupling member, (in this instance the bell cranks 22,20) in such a manner so as to permit travel of the first ends 24' 26' of the foot links 24 and 26 in an arcuate path of travel about the pivot axis X at a predetermined length corresponding to the length of the bell cranks 20, 22. Within the context of this application, "arcuate" shall refer to a circular oval or other such closed, curved path of travel.

A second end 24", 26" of the foot links 24 and 26 respectively terminate in rollers 28 which engage tracks 30, 32. The tracks 30, 32 direct the second end 24", 26" of the foot links 24, 26 in a reciprocal path of travel as the first ends 24', 26' of the links 24, 26 travel about the pivot axis X. Within the context of the this application, a "reciprocal" path of travel is meant to define any back and forth path of travel which is repetitively traversed by the end of the foot link and includes a generally linear path of travel as is provided by the flat track 28, 32 of the FIG. 1 embodiment as well as curved paths of travel provided by other embodiments shown herein.

The apparatus of the FIG. 1 embodiment may further include a friction brake 34 associated with the flywheel 18 for purposes of imposing drag on the wheel so as to increase the amount of exercise provided by the apparatus 10. The friction brake 34 may be adjusted by an adjustment knob 36 operating through a flexible cable 40 upon the friction pad assembly 34, as is well known to those of skill in the art. Other types of braking device such as a magnetic brake and the like may be similarly employed. In the illustrated embodiment, the frame 12 includes a hand grip 42 mounted on an upright portion of the frame 12. The FIG. 1 embodiment 10 further includes foot retaining pads 44 which preferably comprise pads formed at least partially of a relatively soft, high coefficient of friction material such as rubber.

The interaction of the foot links 24 and 26 with the bell cranks 20 and 22 and with the tracks 28 and 32 provide for a unique and smooth foot motion, as will be explained with reference to FIGS. *2a–c*. Referring now to FIG. *2a*, there is shown a stylized depiction of the apparatus of the present invention in use. Illustrated therein is a wheel 48, showing a foot link 50 having a first end coupled thereto and a second end engaged with a track 52. Rotation of the wheel 48 will reposition the foot link 50 along the track, and as illustrated, the orientation of the track and foot at four locations d, c, b and a, corresponding to the forward and upward motion of the foot, 54 are illustrated. It will be noted that as the position changes from d to a the foot 54 rises and moves forward and that the angle formed at the ankle varies.

Referring now to FIG. *2b*, there is shown the same arrangement of parts depicting the subsequent rearward and downward motion of the foot 54. Again, the angle between the foot and leg varies as the rearward and downward motion takes place. It is notable that the path of travel of the foot 54 is not the same for the forward and reverse motion. FIG. *2c* illustrates the oval path as traversed by the user's foot during the cycle of this apparatus. This compound motion is very smooth and natural; consequently, it avoids jarring as well as simple, repetitive back and fourth motion which can overstress particular muscles while neglecting others. Smooth and pleasing motion provided by this particular mechanical arrangement encourages use of the equipment.

Referring now to FIG. 3, there is shown another embodiment of exercise device 56 structured in accord with the principles of the present invention. The device 56 of FIG. 3 is generally similar to that of FIG. 1, and accordingly like structures will be referred to by like reference numerals.

The exercise device 56 includes a frame 12 and foot links 26 as generally described herein above. The device also includes tracks for guiding the foot links, and one track 58 is visible in this drawing. The tracks of the FIG. 3 embodiment differ from those of FIG. 1 insofar as they are somewhat curved in an upward direction. It has been found that the curve provides for a more gradual rise in the elevation of the foot links. In accord with the present invention, the tracks still guide the foot links 24, 26 in a reciprocal path of travel.

The device 56 of FIG. 3 further differs from that of FIG. 1 insofar as the bell cranks 20,22 are somewhat shorter. In other instances the first end of the foot links 24, 26 are pivotally connected directly to the flywheel which functions to couple the foot link to the pivot axis X to permit rotation thereabout. In such instance, the flywheel is preferably a double wheel supported for rotation about a central axis. It will be appreciated that various mechanical arrangements may be employed to couple the foot links 24, 26 to the pivot axis X and such variations may include a larger flywheel, a smaller flywheel or may eliminate the flywheel entirely provided the foot links are coupled so as to permit an arcuate path of travel of the first end of each foot link about the pivot axis X.

Referring now to FIG. 4 there is shown yet another embodiment of exercise device 60 structured in accord with the principles of the present invention. Again, like elements will be indicated by like reference numerals. The exercise device 60 of the FIG. 4 embodiment differs from the previous embodiments insofar as it does not include a track for guiding the second ends 24", 26" of the foot links 24, 26 along the reciprocal path of travel. In this embodiment, the guide member function is provided by a pair of arm links 64 and 66.

Each arm link 64, 66 is pivotally supported by the frame 12 at support point 68. The arm links 64, 66 are also pivotally coupled to the ends 24", 26" of the foot links 24, 26. As indicated by phantom line Y, pivoting of the arm links 64, 66 about the support point 68 causes the second ends 24", 26" of the foot links 24, 26 to reciprocate along the curved path Y.

As illustrated in FIG. 4, the arm links 64,66 also include handle portions **64*a*, 66*a* associated therewith. These handle portions may be configured to be gripped by a user and, during the operation of the device they also reciprocate, thereby providing upper body exercise. It will be appreciated that in some embodiments, the handle portions 64*a*, 66*a*** may be eliminated. In other instances they may be enlarged, bent or otherwise modified to provide an altered range of motion.

Figure 5:
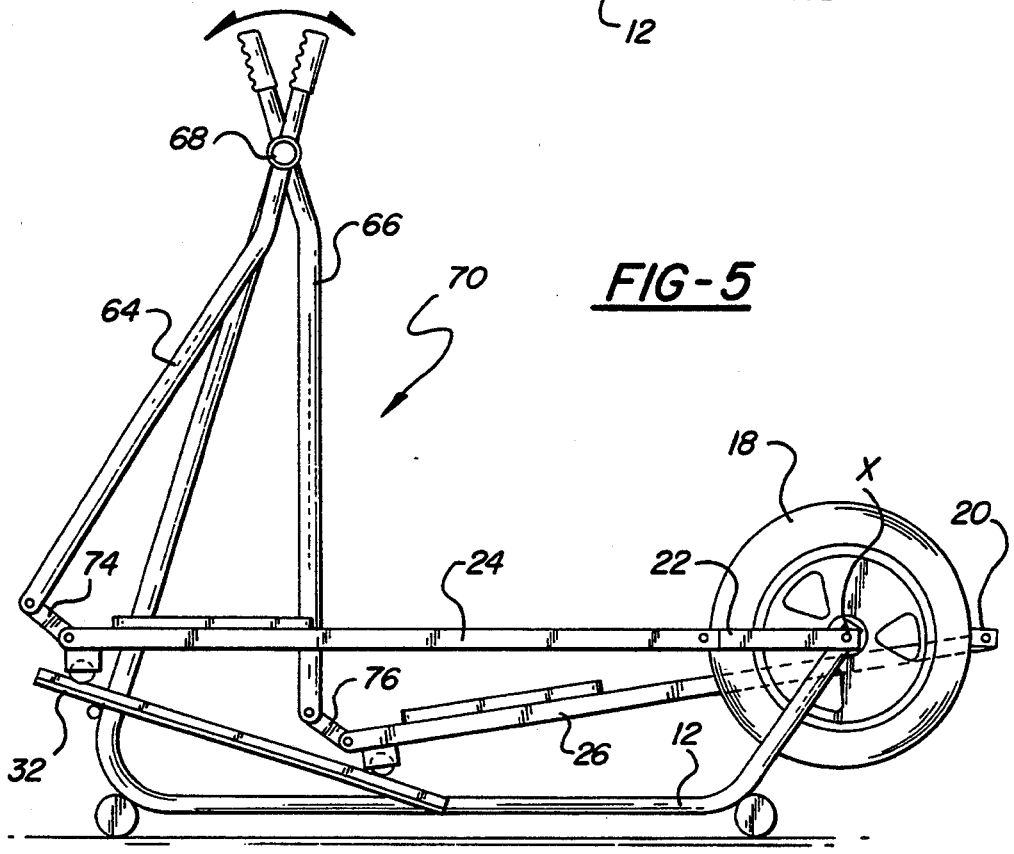
FIG. 5 is a side elevational view of a fourth embodiment of the present invention.

Referring now to FIG. 5 there is shown another embodiment of exercise device 70, structured in accord with the principles of the present invention. The device 70 is generally similar to those previously shown and like structures will be referred to by like reference numerals. The exercise device 70 of FIG. 5 is generally similar to that of FIG. 1 insofar as it includes a frame 12 having a pivot axis X which supports an assembly of foot links 24, 26 and associated bell cranks 20, 22 for rotation thereabout. The embodiment also includes a flywheel 18 and a series of tracks, one of which, 32, is visible in this drawing. As in the FIG. 1 embodiment, the tracks function as guide members for directing the ends of the foot links 24, 26 in a reciprocal path of travel. The FIG. 5 embodiment 70, also includes a pair of arm links 64, 66 associated with the foot links 24, 26. In this embodiment, in contrast to the FIG. 4 embodiment, the arm links 64,66 do not function as guide members but merely serve to provide upper body exercise. Since the track is straight, the arm links 64,66 are connected to the corresponding foot links 24, 26 by a pair of connecting links 74, 76 in order to accommodate their respective paths of travel. In accord with another variation of the present invention, the track of the FIG. 5 embodiment may be made curved, so as to correspond to the motion of the arm links 64, 66 about the support point 68, and in such instance the connecting links 74, 76 may be eliminated. In this particular embodiment, the arm links 64, 66 will also function, to some degree, to guide the foot links 24, 26.

Figure 6:
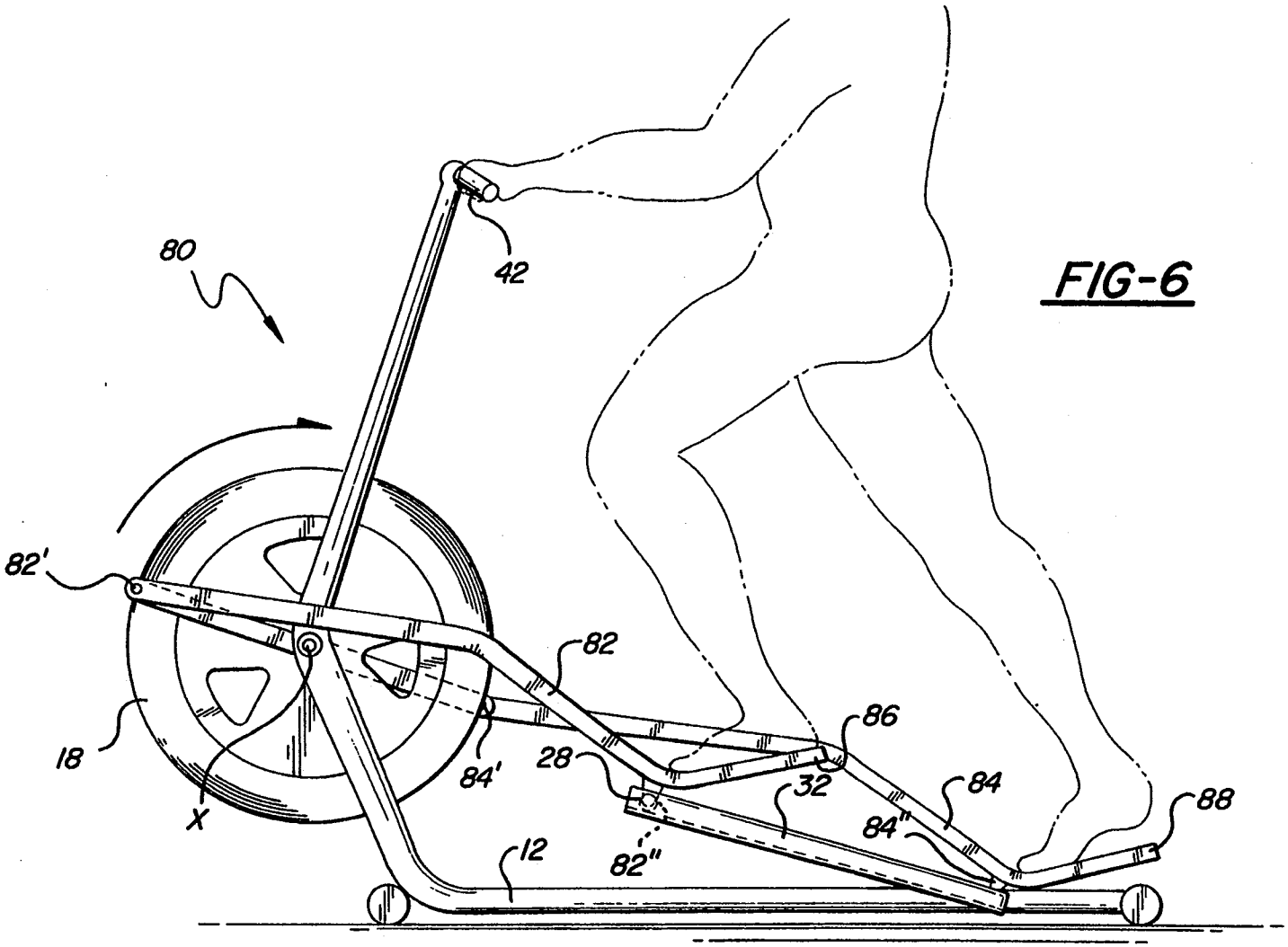
FIG. 6 is another embodiment of the exercise device of the present invention.

Referring now to FIG. 6, there is shown yet another embodiment of an exercise device structured in accord with the principles of the present invention. The device 80 of FIG. 6 is generally similar in construction and operation to the preceding embodiments; however, the location of the flywheel 18 and track, 32 are reversed with regard to the position of the user.

As in the preceding embodiment, the exercise device 80 includes a frame 12 having a pivot axis X defined thereon. A flywheel 18 is supported for rotation about the pivot axis and the device 80 further includes a pair of foot links 82, 84, each of which has a first end 82', 84' pivotally affixed to the flywheel 18, so that they travel in an arcuate path about the pivot axis X. The foot links also include second ends 82", 84" which engage tracks As illustrated, end 82" engages track 32 via a roller 28.

The placement of the foot engaging portion of the foot links 82, 84 differs in the FIG. 6 embodiment from that of the preceding embodiments. The FIG. 6 embodiment includes foot pads 86, 88 which are disposed so as to project from the ends 82" 84" of the foot links 82, 84. It will also be noted that in this embodiment, the foot links are somewhat bent. Finally, the device 80 includes a handle grip portion 42 as in various other preceding embodiments.

Other modifications and variations of the FIG. 6 embodiment are possible within the scope of the present invention. As illustrated, the foot links 82, 84 are coupled to the flywheel by bell cranks 20,22 which pass to the interior of the frame 12. The cranks may pass to the outside of the frame as in the FIG. 1 embodiment. As previously noted, the flywheel and/or bell cranks may be eliminated in some instances.

The principles of the present invention may be adapted to the construction of a variety of other embodiments. As already noted, the size and location of the flywheel may be varied and in some instances, the flywheel may be eliminated or replaced by a series of pulleys or similar structures. The shape and position of the guide members may be similarly varied and auxiliary structures such as braking devices, speedometers, odometers and the like may be incorporated in the device. Accordingly, it will be appreciated that the foregoing drawings, discussion and description are merely meant to illustrate particular embodiments of the invention and are not meant to be limitations upon the practice thereof. It is the following claims, including all equivalents, which define the scope of the invention.

I claim:

1. An exercise device comprising:

a frame having a fixed pivot axis defined thereon, said frame configured to be supported on a floor;

a first and a second foot link, each having a foot engaging portion;

a first and a second coupling member, each associated with a respective one of said foot links for pivotally coupling said foot link to said pivot axis at a predetermined distance therefrom so that a first end of said foot link travels in an arcuate path about said axis;

a first and a second guide member, each guide member being supported by said frame and operative to engage a respective one of said foot links and to direct a second end of said foot link along a preselected, reciprocating path of travel, which is generally inclined with respect to said floor, as the first end of said foot link travels along said arcuate path; so that when said exercise device is in use, and when the second end of one of said foot links travels from a point at a lower end of said inclined path, upward along said inclined path, the heel portion of a user's foot associated therewith initially rises at a faster rate than the toe portion, and when the second end of said foot link travels downward, along said inclined, reciprocating path of travel, the heel portion of the user's foot initially lowers at a faster rate than the toe portion.

2. An exercise device as in claim 1, wherein said coupling member includes a bell crank having a first end which pivotally engages the first end of one of said foot links and a second end which is pivotally affixed to said pivot axis.

3. An exercise device as in claim 1, wherein the foot engagement portion of each foot link is disposed between the first and second ends of said foot link and is configured so that the user's foot is disposed with the toe portion thereof pointing toward the second end when the device is in use, said exercise device being further configured so that when it is in use, the first end of each foot link travels in a counterclockwise arcuate path about said pivot axis, when viewed from the user's left side.

4. An exercise device as in claim 1, further including a flywheel disposed for rotation about said fixed pivot axis.

5. An exercise device as in claim 1, wherein said first and second guide members each comprise a track.

6. An exercise device as in claim 5 wherein said tracks are straight tracks.

7. An exercise device comprising:

a frame having a pivot axis defined thereon, said frame configured to be supported on a floor;

a first and a second foot link, each having a foot engaging portion;

a first and second coupling member, each associated with a respective one of said foot links for pivotally coupling said foot link to said pivot axis at a predetermined distance therefrom so that a first end of said foot link travels in an arcuate path about said axis;

a guide supported by said frame and operative to engage said foot links and to direct a second end of each foot link along a preselected, reciprocating path of travel as the first end of said foot link travels along said arcuate path; so that when said exercise device is in use, and when the second end of one of said foot links travels from a point at a rearward end of said reciprocating path, forward along said path, the heel portion of a user's foot associated therewith initially rises at a faster rate than the toe portion, and when the second end of said foot link travels rearward along said reciprocating path of travel from a forward end thereof, the heel portion of the user's foot initially lowers at a faster rate than the toe portion.

* * * * *

UNITED STATES PATENT AND TRADEMARK OFFICE

CERTIFICATE OF CORRECTION

PATENT NO. : 5,383,829
APPLICATION NO. : 08/106378
DATED : January 24, 1995
INVENTOR(S) : Larry D. Miller It is certified that error appears in the above-identified patent and that said Letters Patent is hereby corrected as shown below:

Title page [*] Notice: Replace, "Sep. 7, 2010" with --The expiration of the full statutory term of U.S. Patent No. 5,242,343--

Signed and Sealed this

Fifth Day of May, 2009

John Doll

JOHN DOLL
*Acting Director of the United States Patent and Trademark Office*

US005383829C1

(12) REEXAMINATION CERTIFICATE (4539th)

United States Patent

Miller

(10) Number: US 5,383,829 C1

(45) Certificate Issued: Mar. 5, 2002

(54) STATIONARY EXERCISE DEVICE

(75) Inventor: Larry Miller, 1628 Treeside Dr., Rochester, MI (US) 48307

(73) Assignee: Larry Miller, Rochester, MI (US)

Reexamination Request:

No. 90/004,848, Nov. 25, 1997
No. 90/004,999, May 15, 1998
No. 90/005,030, Jul. 2, 1998
No. 90/005,450, Aug. 13, 1999
No. 90/005,561, Nov. 12, 1999

Reexamination Certificate for:

Patent No.: 5,383,829
Issued: Jan. 24, 1995
Appl. No.: 08/106,378
Filed: Aug. 13, 1993

( * ) Notice: This patent is subject to a terminal disclaimer.

Related U.S. Application Data

(63) Continuation of application No. 07/953,897, filed on Sep. 30, 1992, now Pat. No. 5,242,343.

(51) Int. Cl.[7] ..... A63B 69/16; A63B 22/04

(52) U.S. Cl. ..... 482/57; 482/51

(58) Field of Search ..... 482/51–53, 57, 482/58, 70, 110, 148

(56) References Cited

U.S. PATENT DOCUMENTS

| | | | | |
|---|---|---|---|---|
| 1,273,906 A | | 7/1918 | Nickey | |
| 1,323,004 A | | 11/1919 | Boyd | |
| 2,641,249 A | | 6/1953 | Brockman | 128/24 |
| 2,826,192 A | | 3/1958 | Mangas | 128/25 |
| 2,892,455 A | | 6/1959 | Hutton | 128/25 |
| 3,432,164 A | | 3/1969 | Deeks | |
| 3,578,800 A | * | 5/1971 | Di Nepi | 482/57 |
| 3,713,438 A | | 1/1973 | Knutsen | |
| 3,824,994 A | | 7/1974 | Soderberg, Sr. | 128/25 |
| 4,185,622 A | | 1/1980 | Swenson | |
| 4,188,030 A | | 2/1980 | Hooper | |
| 4,779,863 A | | 10/1988 | Yang | 272/114 |
| 4,786,050 A | | 11/1988 | Geschwender | |
| 4,986,261 A | | 1/1991 | Iams | 128/25 |
| 5,038,758 A | | 8/1991 | Iams | 128/75 |
| 5,039,088 A | | 8/1991 | Shifferaw | |
| D330,236 S | | 10/1992 | Jarriel et al. | |
| 5,279,529 A | | 1/1994 | Eschenbach | |
| 5,387,167 A | | 2/1995 | Johnston | 482/57 |

FOREIGN PATENT DOCUMENTS

| | | |
|---|---|---|
| CH | 206208 | 11/1939 |

* cited by examiner

*Primary Examiner*—S. R. Crow

(57) ABSTRACT

An exercise device includes a pair of foot engaging links. The first end of each link is supported for rotational motion about a pivot axis and a second end of each foot link is guided in a reciprocal path of travel. The combination of these foot link motions permits the users foot to travel in an inclined, oval path of travel. This natural foot action exerciese a large number of muscles through a wide range of motion.

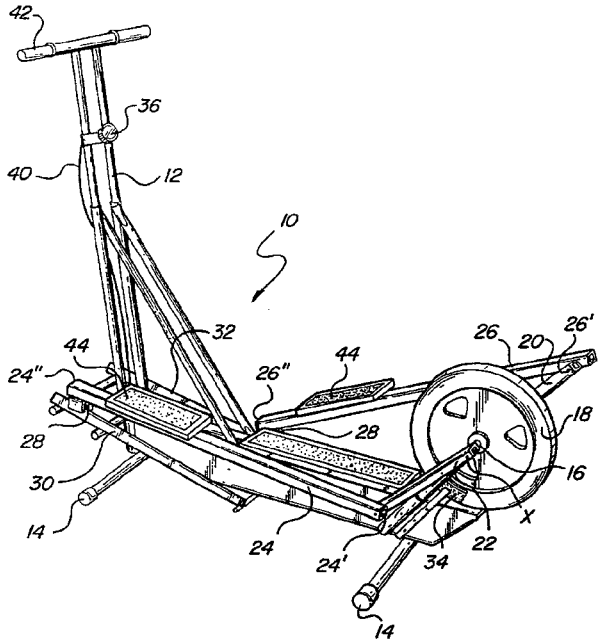

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–6 is confirmed.

Claim 7 is determined to be patentable as amended.

New claims 8–75 are added and determined to be patentable.

7. An exercise device comprising:

a frame having a pivot axis defined thereon, said frame configured to be supported on a floor;

a first and a second foot link, each having a foot engaging portion;

a first and second coupling member, each associated with a respective one of said foot links for pivotally coupling said foot link to said pivot axis at a predetermined distance therefrom so that a first end of said foot link travels in an arcuate path about said axis;

a guide supported by said frame and operative to engage said foot links and to direct a second end of each foot link along a preselected, reciprocating path of travel as the first end of said foot link travels along said arcuate path; so that when said exercise device is in use, and when the second end of one of said foot links travels from a point at a rearward end of said reciprocating path, forward along said path, the heel portion of a user's foot associated therewith initially rises at a faster rate than the toe portion, and when the second end of said foot link travels rearward along said reciprocating path of travel from a forward end thereof, the heel portion of the user's foot initially lowers at a faster rate than the toe portion, *and so that the heel portion of said user's foot travels in a path which does not encompass said pivot axis.*

*8. The exercise device of claim 7, said frame further comprising a handgrip manually graspable by the user during exercise.*

*9. The exercise device of claim 7, further comprising a hand grip manually graspable by the user during exercise.*

*10. The exercise device according to claim 9:*

*said frame comprising a base portion configured to rest on the floor; and*

*said handgrip mounted on a portion of said frame extending upwardly from said base portion.*

*11. The exercise device according to claim 9:*

*said frame comprising a base portion configured to rest on the floor and a post portion extending upwardly from the base portion; and*

*said handgrip coupled to the post portion.*

*12. The exercise device according to claim 11, further comprising means for pivotally mounting the hand grip on said post portion of said frame.*

*13. The exercise device according to claim 7, further comprising a flywheel operably coupled with said pivot axis.*

*14. The exercise device according to claim 7, said foot engaging portion comprises a platform having a width wider than the adjacent portion of the foot link to support the foot of the user standing on the foot link during exercise.*

*15. The exercise device according to claim 7, wherein said guide includes at least one guideway supported by the frame to engage and direct the second ends of the foot links for travel along said guideway.*

*16. The exercise device according to claim 7, wherein said guide includes a roller engaged with the second end of the foot links to support the foot links along their preselected path of travel.*

*17. The exercise device according to claim 7, wherein said guide comprises arm links, said arm links having a first portion coupled to a corresponding foot link and a second distal portion coupled to said frame.*

*18. The exercise device according to claim 17, wherein the second portions of the arm links are coupled to the frame at an elevation above the location at which the first portions of the arm links are coupled to the foot links.*

*19. The exercise device according to claim 18:*

*said frame further comprising an upwardly extending post; and,*

*the second portions of the arm links are coupled to the post.*

*20. The exercise device of claim 18, further comprising handgrips associated with the arm links.*

*21. The exercise device according to claim 17:*

*said frame comprising an upwardly extending post; and*

*said second portions of the arm links are pivotally coupled to the post.*

*22. The exercise device of claim 17, further comprising manually graspable handgrips associated with the arm links.*

*23. The exercise device of claim 22, wherein the handgrips move in coordination with the arm links.*

*24. The exercise device according to claim 7:*

*said frame further comprising an upwardly extending post; and,*

*said guide supported by said post.*

*25. An aerobic exercise device physically powered by the user, comprising:*

*a frame having a pivot axis defined thereon, said frame configured to be supported on a floor;*

*a first and a second foot link, each having a foot-engaging portion;*

*a first and second coupling member, each associated with a respective one of said foot links for pivotally coupling said foot link to said pivot axis at a predetermined distance therefrom so that a first end of said foot link travels in an arcuate path about said axis; and*

*a guide supported by said frame and operative to engage said foot links and to direct a second end of each foot link along a preselected, reciprocating path of travel as the first end of said foot link travels along said arcuate path;*

*whereby when said exercise device is in use, and when the second end of one of said foot links travels from a point at a rearward end of said reciprocating path, forward along said path, the heel portion of a user=s foot associated therewith initially rises at a faster rate than the toe portion, and when the second end of said foot link travels rearward along said reciprocating path of travel from a forward end thereof, the heel portion of the user=s foot initially lowers at a faster rate than the*

*toe portion such that use of the exercise device, without motorized assistance, produces aerobic activity comprising natural foot motion.*

*26. The exercise device of claim 25, said guide further comprises a handgrip graspable by the user during exercise.*

*27. The exercise device of claim 25, further comprising a hand grip manually graspable by the user during exercise.*

*28. The exercise device according to claim 27:*

*said frame comprising a base portion configured to rest on the floor; and*

*said handgrip mounted on a portion of said frame extending upwardly from said base portion.*

*29. The exercise device according to claim 27:*

*said frame comprising a base portion configured to rest on the floor and a post portion extending upwardly from the base portion; and*

*said handgrip coupled to the post portion.*

*30. The exercise device according to claim 29, further comprising means for pivotally mounting the hand grip on said post portion of said frame.*

*31. The exercise device according to claim 25, further comprising a flywheel operably coupled with said pivot axis.*

*32. The exercise device according to claim 25, said foot engaging portion comprises a platform having a width wider than the adjacent portion of the foot link to support the foot of the user standing on the foot link during exercise.*

*33. The exercise device according to claim 25, said guide includes at least one guideway supported by the frame to engage and direct the second end portions of the foot links for travel along said guideway.*

*34. The exercise device according to claim 25, said guide includes a roller engaged with the second end portions of the foot links to support the foot links along their preselected path of travel.*

*35. The exercise device according to claim 25, said guide comprises arm links, said arm links having a first portion coupled to a corresponding foot link and a second distal portion coupled to said frame.*

*36. The exercise device according to claim 35, the second portion of the arm links are coupled to the frame at an elevation above the location at which the first portions of the arm links are coupled to the foot links.*

*37. The exercise device according to claim 36:*

*said frame further comprising an upwardly extending post; and,*

*the second portions of the arm links are coupled to the post.*

*38. The exercise device of claim 36, further comprising handgrips associated with the swing arms.*

*39. The exercise device according to claim 35, said frame comprising an upwardly extending post, and said second portions of the arm links are pivotally connected to the post.*

*40. The exercise device of claim 35, further comprising manually graspable handgrips associated with the swing arms.*

*41. The exercise device of claim 40, wherein the handgrips move in coordination with the arm links.*

*42. The exercise device according to claim 25:*

*said frame further comprising an upwardly extending post; and,*

*said guide supported by said post.*

*43. An aerobic exercise device physically powered by the user, comprising:*

*a frame having a pivot axis defined thereon, said frame configured to be supported on a floor;*

*handgrips manually graspable by the user during exercise;*

*a first and a second foot link, each having a foot-engaging portion;*

*a first and second coupling member, each associated with a respective one of said foot links for pivotally coupling said foot link to said pivot axis at a predetermined distance therefrom so that a first end of said foot link travels in an arcuate path about said axis; and*

*a guide supported by said frame and operative to engage said foot links and to direct a second end of each foot link along a preselected, reciprocating path of travel as the first end of said foot link travels along said arcuate path;*

*whereby when said exercise device is in use, and when the second end of one of said foot links travels from a point at a rearward end of said reciprocating path, forward along said path, the heel portion of a user=s foot associated therewith initially rises at a faster rate than the toe portion, and when the second end of said foot link travels rearward along said reciprocating path of travel from a forward end thereof, the heel portion of the user=s foot initially lowers at a faster rate than the toe portion to simulate a natural gait and such that use of the exercise device, without motorized assistance, produces aerobic activity.*

*44. The exercise device according to claim 43:*

*said frame comprising a base portion configured to rest on the floor and a post portion extending upwardly from the base portion; and*

*said hand grips coupled to the post portion.*

*45. The exercise device according to claim 44, further comprising means for pivotally mounting the hand grips on said post portion.*

*46. The exercise device according to claim 43, further comprising a flywheel operably coupled with said pivot axis.*

*47. The exercise device according to claim 43, said foot engaging portion comprises a platform having a width wider than the adjacent portion of the foot link to support the foot of the user standing on the foot link during exercise.*

*48. The exercise device according to claim 43, wherein said guide includes at least one guideway supported by the frame to engage and direct the second end portions of the foot links for travel along said guideway.*

*49. The exercise device according to claim 43, said guide includes a roller engaged with the second end portions of the foot links to support the foot links along their preselected path of travel.*

*50. The exercise device according to claim 43, said guide comprising arm links, said arm links having a first portion coupled to a corresponding foot link and a second distal portion coupled to said frame.*

*51. The exercise device according to claim 50, wherein the second portion of the arm links are coupled to the frame at an elevation above the location at which the first portions of the arm links are coupled to the foot links.*

*52. The exercise device according to claim 50, said frame comprising an upwardly extending post, and said second portions of the arm links are pivotally connected to the post.*

*53. The exercise device according to claim 43:*

*said frame further comprising an upwardly extending post; and*

*said guide supported by said post.*

*54. An exercise device comprising:*

*a frame having a fixed pivot axis defined thereon, said frame configured to be supported on a floor;*

*a first and a second foot link, each having a foot-engaging portion;*

*a first and a second coupling member, each associated with a respective one of said foot links for pivotally coupling said foot link to said pivot axis at a predetermined distance therefrom so that a first end of said foot link travels in an arcuate path about said axis;*

*a first and a second guide member, each guide member being supported by said frame and operative to engage a respective one of said foot links and to direct a second end of said foot link along a preselected, reciprocating path of travel, which is generally inclined with respect to said floor, as the first end of said foot link travels along said arcuate path; so that when said exercise device is in use, and when the second end of said foot links travels from a point at a lower end of said inclined path, upward along said inclined path, the heel portion of a user's foot associated therewith initially rises at a faster rate than the toe portion, and when the second end of said foot link travels downward, along said inclined, reciprocating path of travel, the heel portion of the user's foot initially lowers at a faster rate than the toe portion, and so that the ankle portion of said user's foot travels in a path which is always outside of said arcuate path.*

*55. The exercise device of claim 54, wherein the entirety of said user's foot travels in said path which is always outside of the arcuate path.*

*56. The exercise device of claim 54, wherein said first and second guide members each include a roller, engageable with its respective foot link to support said foot link along its preselected path of travel.*

*57. The exercise device of claim 54, wherein said first and second guide members each comprise an arm link having a first portion coupled to a respective foot link, and a second portion, distal from said portion, coupled to said frame.*

*58. The exercise device of claim 54, wherein said first and second coupling members couple their respective foot links to said pivot axis at a fixed distance therefrom.*

*59. An exercise device comprising:*

*a frame having a pivot axis defined thereon, said frame configured to be supported on a floor;*

*a first and a second foot link, each having a foot-engaging portion;*

*a first and second coupling member, each associated with a respective one of said foot links for pivotally coupling said foot link to said pivot axis at a predetermined distance therefrom so that a first end of said foot link travels in an arcuate path about said axis;*

*a guide supported by said frame and operative to engage said foot links and to direct a second end of said foot link along a preselected, reciprocating path of travel as the first end of said foot link travels along said arcuate path; so that when said exercise device is in use, and when the second end of one of said foot links travels from a point at a rearward end of said reciprocating path, forward along said path, the heel portion of a user's foot associated therewith initially rises at a faster rate than the toe portion, and when the second end of said foot link travels rearward along said reciprocating path of travel from a forward end thereof, the heel portion of the user's foot initially lowers at a faster rate than the toe portion and so that the ankle portion of said user's foot travels in a path which is always outside of said arcuate path.*

*60. The exercise device of claim 59, wherein the entirety of said user's foot travels in said path which is always outside of the arcuate path.*

*61. The exercise device of claim 59, wherein said guide includes at least one roller engageable with said foot links to support the foot links as they travel along their preselected path.*

*62. The exercise device of claim 59, wherein said guide comprises first and second arm links, each arm link having a first portion coupled to a corresponding foot link, and a second portion distal from said first portion, coupled to said frame.*

*63. The exercise device of claim 59, wherein said first and second coupling members couple their respective foot links to said pivot axis at a fixed distance therefrom.*

*64. An exercise device comprising:*

*a frame having a fixed pivot axis defined thereon, said frame configured to be supported on a floor;*

*a first and a second foot link, each having a foot-engaging portion;*

*a first and a second coupling member, each associated with a respective one of said foot links for pivotally coupling said foot link to said pivot axis at a predetermined distance therefrom so that a first end of said foot link travels in an arcuate path about said axis;*

*a first and a second guide member, each guide member being supported by said frame and operative to engage a respective one of said foot links and to direct a second end of said foot link along a preselected, reciprocating path of travel, which is generally inclined with respect to said floor, as the first end of said foot link travels along said acruate path; so that when said exercise device is in use, and when the second end of said foot links travels from a point at a lower end of said inclined path, upward along said inclined path, the heel portion of a user's foot associated therewith initially rises at a faster rate than the toe portion, and when the second end of said foot link travels downward, along said inclined, reciprocating path of travel, the heel portion of the user's foot initially lowers at a faster rate than the toe portion, and so that the ankle portion of said user's foot travels in a path which does not cross a vertical plane passing through said pivot axis.*

*65. The exercise device of claim 64, wherein said first and second guide members each include a roller, engageable with its respective foot link to support said foot link along its preselected path of travel.*

*66. The exercise device of claim 64, wherein said first and second guide members each copmrise an arm link having a first portion coupled to a respective foot link, and a second portion, distal from said portion, coupled to said frame.*

*67. The exercise device of claim 64, wherein said first and second coupling members couple their respective foot links to said pivot axis at a fixed distance therefrom.*

*68. An exercise device comprising:*

*a frame having a pivot axis defined thereon, said frame configured to be supported on a floor;*

*a first and a second foot link, each having a foot-engaging portion;*

*a first and second coupling member, each associated with a respective one of said foot links for pivotally coupling said foot link to said pivot axis at a predetermined distance therefrom so that a first end of said foot link travels in an arcuate path about said axis;*

*a guide supported by said frame and operative to engage said foot links and to direct a second end of said foot link along a preselected, reciprocating path of travel as the first end of said foot link travels along said arcuate path; so that when said exercise device is in use, and*

*when the second end of one of said foot links travels from a point at a rearward end of said reciprocating path, forward along said path, the heel portion of a user's foot associated therewith initially rises at a faster rate than the toe portion, and when the second end of said foot link travels rearward along said reciprocating path of travel from a forward end thereof, the heel portion of the user's foot initially lowers at a faster rate than the toe portion and so that the heel portion of said user's foot travels in a path which does not cross a vertical plane passing through said pivot axis.*

*69. The exercise device of claim 68, wherein said guide includes at least one roller engageable with said foot links to support the foot links as they travel along their preselected path.*

*70. The exercise device of claim 68, wherein said guide comprises first and second arm links, each arm link having a first portion coupled to a corresponding foot link, and a second portion distal from said first portion, coupled to said frame.*

*71. The exercise device of claim 68, wherein said first and second coupling members couple their respective foot links to said pivot axis at a fixed distance therefrom.*

*72. The exercise device of claim 1, wherein said first and second coupling members couple their respective foot links to said pivot axis at a fixed distance therefrom.*

*73. The exercise device of claim 7, wherein said first and second coupling members couple their respective foot links to said pivot axis at a fixed distance therefrom.*

*74. The exercise device of claim 25, wherein said first and second coupling members couple their respective foot links to said pivot axis at a fixed distance therefrom.*

*75. The exercise device of claim 43, wherein said first and second coupling members couple their respective foot links to said pivot axis at a fixed distance therefrom.*

* * * * *